United States Patent [19]

Streetman et al.

[11] Patent Number: 4,524,105

[45] Date of Patent: Jun. 18, 1985

[54] MELT-SPUN ACRYLONITRILE POLYMER FIBER OF IMPROVED PROPERTIES

[75] Inventors: William E. Streetman, Gulf Breeze; Shashikumar H. Daftary, Pensacola, both of Fla.

[73] Assignee: American Cyanamid Company, Stamford, Conn.

[21] Appl. No.: 140,043

[22] Filed: Apr. 14, 1980

Related U.S. Application Data

[63] Continuation-in-part of Ser. No. 853,014, Nov. 17, 1977, abandoned.

[51] Int. Cl.[3] ..... D02G 3/00

[52] U.S. Cl. ..... 428/364; 57/200; 264/206

[58] Field of Search ..... 428/364; 526/234, 287, 526/329.3; 57/200, 243; 264/206; 260/29.6 AN

[56] References Cited

U.S. PATENT DOCUMENTS

| | | | |
|---|---|---|---|
| 2,445,042 | 7/1948 | Silverman | 526/341 X |
| 3,923,755 | 12/1975 | Piloni | 526/287 |
| 4,219,523 | 8/1980 | Porosoff | 264/206 |

*Primary Examiner*—Lorraine T. Kendell

*Attorney, Agent, or Firm*—Frank M. Van Riet

[57] ABSTRACT

There is disclosed a melt-spun acrylonitrile polymer fiber of improved dye intensity and reduced shade change due to hot-wet processing.

2 Claims, No Drawings

MELT-SPUN ACRYLONITRILE POLYMER FIBER OF IMPROVED PROPERTIES

CROSS-REFERENCE TO RELATED APPLICATIONS

This application is a continuation-in-part of application Ser. No. 853,014 filed Nov. 17, 1977 and now abandoned.

This invention relates to a melt-spun acrylonitrile polymer fiber of improved dyeing characteristics. More particularly, this invention relates to such a fiber having improved dye intensity and decreased shade change due to hot-wet processing and being superior to similar fiber prepare by wet spinning procedures in strength properties and yarn characteristics.

Commercial production of acrylonitrile polymer fiber currently involves wet-spinning or dry-spinning procedures. In both procedures, the acrylonitrile polymer is dissolved in a suitable solvent, extruded through a spinneret into a coagulating medium to remove the polymer solvent, and subjected to such additional processing as is necessary to provide fiber of desirable properties. The commercially desirable fiber is that which has a full range of dyeability in all color shades and has attractive textile properties. However, the requirement for a polymer solvent is an undesirable feature of these processes since it necessitates solvent recovery provisions to avoid environmental pollution which complicates processing. The preferred procedure for preparing acrylonitrile fiber would be that of melt-spinning but because the acrylonitrile polymer deteriorates or decomposes at temperatures below its melting point, the conventional melt-spinning procedures appropriate for other polymer types cannot be used.

Recent developments in this art, as described in U.S. Pat. No. 3,896,204, issued July 22, 1975 to A. Goodman and M. A. Suwyn and U.S. Pat. No. 3,984,601, issued Oct. 5, 1976 to R. H. Blickenstaff, for example, indicate that when an acrylonitrile polymer and water in proper proportions are heated to temperatures above the boiling point of water and under pressure sufficient to maintain water in liquid state, a homogeneous single-phase fusion melt is obtained at a temperature below the deterioration or decomposition point of the acrylonitrile polymer. The art also teaches that this fusion melt of acrylonitrile polymer and water can be melt-spun into fiber and avoid the solvent recovery problems associated with wet-spinning or dry-spinning. The acrylonitrile polymer fiber obtained by these modified melt-spinning procedures is characterized as having a sheath-core structure, a density gradient across the sheath, a significant void structure, and a luster arising from internally reflected light.

The presence of significant void structure within an acrylonitrile polymer fiber is responsible for two serious deficiencies of the melt-spun acrylonitrile polymer fiber that adversely affect its commodity value. The void structure, because it results in a fiber which is not transparent, severely reduces the dye intensity, which will be described in detail hereinbelow, and not only increases dye requirements for a particular color shade but also makes heavy shades, such as blacks and navy blues, impractical to achieve. Also, the void structure because it is unstable to hot-wet processing causes severe shade changes (also defined hereinbelow) in the dyed fiber when subjected to hot-wet processing, which further accentuates the dyeing problems of such melt-spun acrylonitrile polymer fiber.

There exists, therefore, the need for a melt-spun acrylonitrile polymer fiber which has improved dye intensity and decreased shade changes. The provision for such a fiber would constitute a significant advance in the art and would increase the commodity value of such a fiber.

In accordance with the present invention there is provided a melt-spun acrylonitrile polymer fiber having a dye intensity of at least about 60 and a shade change due to hot-wet processing of less than about 15, said fiber being further characterized by the fact that it has a straight tenacity of greater than about 3.8 grams/denier and a loop tenacity of greater than about 2.5 grams/denier and provides higher yarn spin limits than acrylonitrile polymer fiber produced by other spinning procedures while also providing higher yarn strength and single end breaks than comparable yarn spun from acrylonitrile polymer fiber produced by other spinning procedures.

The melt-spun acrylonitrile polymer fiber of the present invention has improved dye intensity and shade change due to hot wet processing over the prior art melt-spun acrylonitrile polymer fiber which typically has dye intensity values of 35–40 and shade changes due to hot-wet processing of 25–30 or more. In preferred instances, the melt-spun acrylonitrile polymer of the present invention has a dye intensity value of at least about 75 and a shade change due to hot-wet processing of about 10 or less. With respect to prior art wet-spun or dry-spun acrylonitrile polymer fiber, the melt-spun acrylonitrile polymer fiber of the present invention has higher straight and loop tenacities and allows higher spin limits in preparing yarn while at the same time providing yarns of higher strength and single end breaks. Also, the melt-spun acrylonitrile polymer fiber of the present invention provides high quality yarns at lower twist multiplier than that normally used for wet-spun and dry-spun acrylonitrile polymer fiber. Thus, the acrylonitrile polymer fiber of the present invention distinguishes over prior melt-spun as well as dry- and wet-spun acrylonitrile polymer fibers.

By "dye intensity", as that term is employed herein and in the appended claims, is meant the relative color value obtained by dyeing the melt-spun acrylonitrile fiber with a given quantity of a selected dye compared to the color value obtained by dyeing a wet-spun acrylonitrile polymer fiber of the same polymer with the same quantity of the same dye, the dyeing of the wet-spun acrylonitrile polymer fiber arbitrarily being assigned to relative value of 100. Differences in dye intensity being melt-spun and wet-spun acrylonitrile polymer fibers are attributable to differences of transparency thereof and differences in transparency in turn are attributable to differences in void structure of the fibers, the wet-spun acrylonitrile polymer fiber being essentially free of void structure.

By "shade change due to hot-wet processing", as that term is used herein and in the appended claims, is meant the extent to which the color value of the dyed melt spun acrylonitrile polymer fiber varies as a result of subjection thereof to a hot-wet processing operation relative to an air-dried dyed fiber. The shade change due to hot-wet processing is attributable to changes in void structure, which is unstable to hot-wet processing.

Although void structure in a melt-spun acrylonitrile polymer fiber adversely affects both dye intensity and shade change due to hot-wet processing, the relationship between void structure and these dyeing properties is not one of simple inverse arithmetic proportion. Instead, it appears that only a minor level of void structure by volume can produce a major loss in dye intensity or a major shade change due to hot-wet processing. In some instances, it is possible to improve dye intensity without providing the desired low value of shade change due to hot-wet processing. The particular result desired in accordance with the present invention is that of both improved dye intensity and reduced shade change due to hot wet processing in order to provide melt-spun acrylonitrile polymer fiber of acceptable commodity value.

The melt-spun acrylonitrile polymer fiber of the present invention has a thread-like or filamentary structure typical of natural and synthetic fibers. It is a synthetic melt-spun fiber in which the structure-forming material is an acrylonitrile polymer composition, otherwise termed a polymer matrix structure. In the present fiber, the polymer matrix structure is substantially homogeneous. By the expression "homogeneous polymer matrix structure" is meant that the fiber structure is substantially the same at all points therein. This means that the fiber is substantially void free, is substantially free of any sheath-core structure, and does not possess any significant density gradient across its cross-section. As a result, the fiber is essentially transparent and possesses stability to hot-wet processing. By "essentially transparent" is meant that the fiber provides a dye intensity of at least about 60, and preferably at least about 70. By "stability to hot-wet processing" is meant that the dyed fiber exhibits a shade change of less than about 15, preferably less than about 10, when subjected to a hot-wet processing step. Since the fiber is essentially transparent, it is inherently lustrous and does not depend upon internal reflection as a luster source.

A method for providing the fiber of the present invention is that of controlling the melt-spinning fiber-making process so as to void the substantial formation of void structure within the fiber as processed. It is believed that void structure results from the presence of a separate water phase within the fiber structure at critical times in processing the eventual removal of this water results in the void structure. By use of an acrylonitrile polymer composition having hydrophilic moieties associated therewith, the formation of a separate water phase during critical stages of the fiber making process can be avoided. Residual water carried over in processing can be removed under specified humidity conditions as reflected by dry and wet bulb temperatures. Additional processing features may also be used to augment the dyeing characteristics described.

To prepare the melt-spun, substantially void-free acrylonitrile polymer fiber of the present invention, a suitable acrylonitrile polymer composition is selected to form the polymer matrix structure. Any acrylonitrile polymer composition having at least about 50 weight percent of acrylonitrile units is suitable provided the polymer composition also has associated therewith hydrophilic moieties to achieve the specified values of dye intensity and shade change due to hot-wet processing. There are a number of techniques by which the hydrophilic moieties can be introduced into the acrylonitrile polymer composition effectively.

One method of introducing hydrophilic units into an acrylonitrile polymer composition is to copolymerize acrylonitrile with a hydrophilic comonomer. Another method is to polymerize the acrylonitrile polymer composition in the presence of a redox initiator system that introduces acid groups at the polymer chain ends. Yet another method is to polymerize the acrylonitrile polymer composition in the presence of a pre-formed hydrophilic polymer such as polyvinyl alcohol. Still another method is to hydrolyze a small portion of the acrylonitrile units of a pre-formed acrylonitrile polymer to provide hydrophilic acrylic acid and/or acrylamide units. Further, one can modify a portion of the acrylonitrile units of a pre-formed acrylonitrile polymer by suitable reaction to provide hydrophilic groups, such as by reaction with ethylenediamine to provide imidazoline units. These and other methods known to those skilled in the art can be used alone or in combination to provide hydrophilic units associated with the acrylonitrile polymer composition used to prepare the fiber of the present invention.

An acrylonitrile polymer composition useful to provide the fiber of the present invention may be a single polymer or a blend of compatible polymers so long as the composition provides a minimum of at least about 50 weight percent of acrylonitrile units and hydrophilic moieties associated therewith to achieve the specified values of dye intensity and shade change. The term "polymer composition" as that term is used herein and in the appended claims is meant to include appropriate graft or block polymers either alone or in admixture with other polymers whether grafted or block. Individual compatible polymers in blends need not contain the specified amounts of acrylonitrile units or hydrophilic moieties so long as the total blend composition provides the required amounts of such materials. By "hydrophilic moieties" as that term is used herein and in the appended claims are meant those portions of the acrylonitrile polymer composition that are hydrophilic and include such moieties as sulfonic acid groups, polyvinyl alcohol segments, repeating comonomer units, and the like. By "associated therewith" as that term is used herein and in the appended claims is meant that such hydrophilic units are present in the acrylonitrile polymer composition in a manner appropriate for the particular hydrophilic moieties involved. Thus, sulfonic acid groups may arise as end groups on polymer chains or as functional group on a comonomer; polyvinyl alcohol moieties may be present as part of a grafted polymer; other hydrophilic moieties may arise as repeating units in a copolymer prepared from two or more monomers or as a result of hydrolyzing a suitable polymer; they may also arise as a result of suitable reaction or a preformed polymer; they may arise as a compatible polymer blend; and such other methods as are known to those skilled in the art. Thus, the term "associated therewith" is intended to include the various manners in which hydrophilic moieties are present in the acrylonitrile polymer composition since no other terminology is appropriate to cover all of the manners described.

The amount of hydrophilic moieties in a given acrylonitrile polymer composition that achieves the specified values of dye intensity and shade change will vary widely depending upon many factors. The content of hydrophilic moieties will be influenced by the nature of the hydrophilic groups, the molecular weight of the polymer, the content of acrylonitrile in the polymer, the nature of the polymer composition, i.e., copolymer, graft, blend, etc., the presence or absence of more than one type of hydrophilic moieties, processing conditions and other variables. However, useful contents of hydrophilic moieties can readily be found by trial following the teachings given herein as a guide.

Individual acrylonitrile polymers useful in preparing the acrylonitrile polymer composition for melt-spinning the fiber of the present invention do not have to contain the hydrophilic moieties or acrylonitrile units, as indicated above, so long as the acrylonitrile polymer composition is suitably constituted to provide these components. With such contents implicit, suitable acrylonitrile polymers include homopolymers of acrylonitrile and copolymers of acrylonitrile and one or more of the following monomers:

HYDROPHOBIC MONOMERS

Methyl methacrylate, ethyl acrylate, butyl acrylate, methoxymethyl acrylate, beta-chloroethyl acrylate, and the corresponding esters of methacrylic acid and chloroacrylic acid; vinyl chloride, vinyl fluoride, vinyl bromide, vinylidene chloride, vinylidene bromide, allyl chloride, 1-chloro-1-bromoethylene; methacrylonitrile; methyl vinyl ketone; vinyl formate, vinyl acetate, vinyl propionate, vinyl stearate, vinyl benzoate; N-vinyl phthalimide, N-vinyl succinimide; methylene malonic esters; itaconic esters; N-vinyl carbazole; vinyl furan; alkyl vinyl ethers; diethyl citraconate, diethylmesaconate; styrene, dibromostyrene; vinyl naphthalene; 2-methyl-1-vinylimidazole, 4-methyl-1-vinylimidazole, 5-methyl-1-vinylimidazole; and the like.

HYDROPHILIC MONOMERS

Acrylic acid, methacrylic acid, alphachloroacrylic acid, itaconic acid, vinyl sulfonic acid, styrene sulfonic acid, methallyl sulfonic acid, p-methoxyallyl benzene sulfonic acid, acrylamidomethylpropane sulfonic acid, ethylene-$\alpha$-$\beta$-dicarboxylic acids and their salts; acrylamide, methacrylamide, dimethylacrylamide, isopropylacrylamide; allyl alcohol; 2-vinylpyridine, 4-vinylpyridine, 2-methyl-5-vinylpyridine; vinylpyrrolidone; vinylpiperidone; 1,2-dihydroxypropylmethacrylate, hydroxyethyl methacrylate; 1-trimethylammonium-2-hydroxypropyl methacrylate methosulfate; and the like.

In preparing acrylonitrile polymers and copolymers it is desirable to employ redox systems such as sodium persulfate-sodium bisulfate to initiate and control the polymerization. Such use results in sulfonic acid end groups on the polymer formed. The proportion of sulfonic acid end groups in the polymer will vary with molecular weight of the polymer, higher proportions being present in polymers of low molecular weight. These sulfonic acid end groups should be taken into account when determining the content of hydrophilic moieties in the acrylonitrile polymer composition used to provide the fiber of the present invention. Acrylonitrile polymer compositions containing sulfonic acid groups arising solely from the use of an appropriate redox system can be effectively employed to provide the fiber of the present invention. When hydrophilic pre-formed polymers such as polyvinyl alcohol, polyvinyl pyrrolidone, polyethylene oxide, polyacrylamide, polyacrylic acid, and the like are to be used to provide the acrylonitrile polymer composition, it is desirable that such pre-formed polymers be added to the monomer composition to be polymerized to provide the acrylonitrile units. Individual polymers of the composition may range in molecular weight from about 10,000 to 200,000 or more so long as the composition provides fiber of desirable properties.

Once a desired acrylonitrile polymer composition for forming fiber has been selected, it is next necessary to prepare a single phase homogeneous fusion melt of the composition and water. As indicated earlier, a single phase fusion melt of acrylonitrile polymer composition and water results when suitable quantities of polymer composition and water are heated at elevated temperature and pressure sufficient to maintain water in liquid state. The amount of water necessary will vary depending upon the polymer composition employed. For a given polymer composition, there will be a range of water contents that will provide the single phase fusion melt at the operating temperature and pressure. This can readily be determined from a phase diagram. Use of too low a water content or temperature will result in a separate phase of unmelted polymer. Use of too high a water content will result in a separate phase of polymer-water melt and an added phase of free water. The fusion melt should be obtained at a temperature safely below the deterioration or decomposition temperature of the polymer composition. Sufficient temperature and mixing should be employed to ensure that a homogeneous fusion melt is obtained.

The fusion melt is conveniently obtained in conjunction with spinning using a screw extruder coupled with a pump and spinnerette. A suitable procedure for melt extrusion is described in U.S. Pat. No. 3,991,153, issued Nov. 9, 1976 to G. K. Klausner et al. Other types of melt-spinning devices may be used such as a piston extruder in conjunction with a spinnerette, for example.

The fiber of the present invention may be obtained in a variety of melt-spinning procedures employing the fusion melt of acrylonitrile polymer composition and water. The fusion melt may be extruded through a spinnerette into any suitable environment, subjected to orientation stretching and such other processing options as may be desired. The resulting fiber may also be subjected to such additional processing steps as may be desired.

In carrying out a preferred method for preparing the fiber of the present invention the homogeneous single phase fusion melt of acrylonitrile polymer composition and water is extruded through a spinnerette directly into a steam pressurized solidification zone maintained under conditions such that the nascent extrudate is solidified but is maintained in a plastic state so that the nascent extrudate may be subjected to orientation stretching while within the solidification zone. As the stretched extrudate emerges from the solidification zone, it enters atmospheric conditions.

After the extrudate has emerged from the solidification zone, the extrudate is next subjected to conditioning in an oven maintained at certain conditions of temperature and humidity as reflected by dry and wet bulb temperatures. Generally the dry bulb will be in the range of about 120°–180° C. and the wet bulb temperature will be in the range of about 60°–100° C. The time of treatment may vary widely depending upon the wet and dry bulb temperatures used and generally will vary from about 10 to 15 minutes. This conditioning step is conducted before any uncontrolled or tensionless shrinkage of the extrudate has occurred. This conditioning step may be conducted on the extrudate in a free-to-shrink condition or under tension.

After conducting the conditioning step as described, one may conduct additional optional processing steps if desired. Subsequent to the conditioning step described immediately above, certain optional processing steps may be carried out to augment the dyeing characteristics. One provision is to subject the conditioned extrudate to dry heat at a temperature in the range of about 130°–220° C. for 1 to 30 minutes, the time decreasing with increasing temperature. A second provision is to subject the conditioned extrudate to steaming such as in an autoclave.

The invention is more fully illustrated by the Examples which follow wherein all parts and percentages are by weight unless otherwise specified.

In the Examples which follow, dye intensity and shade change values are given. These values are obtained in accordance with the following procedures.

DYE INTENSITY

A sample of fiber is dyed with Basic Blue 1 at 0.5 weight percent, based on the weight of fiber, to complete exhaustion. The dyed sample is then dried in air at room temperature and a reflectance measurement is made versus a control using the Color-Eye at 620 millimicrons. The control sample is a commercial wet spun acrylic fiber of the same denier dyed and handled in the same manner as the experimental fiber. The result is reported as the percent reflectance of that achieved by the control. In the case where the experimental fiber has more void structure than the control, there will be more light scattered and the dyed experimental fiber will register less than 100% reflectance at 620 millimicrons. The fiber will also appear to the eye to be lighter in color than the control.

SHADE CHANGE

A twenty gram sample of carded and scoured fiber is dyed with 0.5 weight percent of Basic Blue 1, based on the weight of fiber, at the boil until complete exhaustion occurs. One portion of the dyed fiber is dried in air at room temperature. Another portion is dried in an oven at 300° F., for 20 minutes. Reflectances of both samples are obtained using the Color-Eye at 620 millimicrons. The change in reflectance of the oven-dried sample relative to the reflectance of the air dried sample is the shade change.

EXAMPLE 1

A polymer of 89.3 weight percent acrylonitrile units and 10.7 weight percent methyl methacrylate units prepared with a redox system of sodium persulfate and sodium metabisulfite as initiator was produced by suspension polymerization obtaining a polymer of molecular weight of 48,000. End groups of the polymer contained sufficient sulfonic acid groups to provide a sulfur content of 0.167 weight percent.

To 82.3 parts of polymer were added 17.7 parts of water to provide a composition for a fusion melt. The composition was heated in conjunction with a screw extruder to provide a single phase fusion melt which was extruded through a spinnerette having 9060 orifices each of a diameter of 120 microns. The melt zone of the extruder was 190° C. and the pump outlet temperature was 200° C. Production rate was 60 pounds per hour. The extrudate was extruded directly into a steam pressurized solidification zone maintained at a saturated steam pressure of 20 lbs./sq. inch gauge. The extrudate while within the steam pressurized solidification zone was stretched in a first stage at a ratio of 3.7 and in a second stage at a ratio of 12.0 relative to the linear speed of the fusion melt through the spinneret to provide a total stretch ratio of 44.3. The fiber as produced had a denier of 2.4 per filament. The fiber was divided into three portions and further processed as follows:

A first portion was conventionally processed for comparison purposes. The stretched filaments were subjected to steaming in an autoclave at a steam pressure of 21 lbs. for 15 minutes, the filament being in a free-to-shrink condition. A shrinkage of 30% occurred, providing a fiber of 3.4 denier/filament. This fiber had a dye intensity of 40 and a shade change of 13 when subjected to hot-wet processing.

A second portion of the stretched filaments was subjected to conditioning in a free-to-shrink state at a dry bulb temperature of 150° C. and a wet bulb temperature of 90° C. for 20 minutes. The filaments were then subjected to steaming in an autoclave at a steam pressure of 21 lbs. for 15 minutes, the filaments being in a free-to-shrink condition. A shrinkage of 30% occurred providing a fiber of 3.4 denier/filament. This fiber had a dye intensity of 62 and a shade change of 13.

A third portion of the stretched filaments was subjected to conditioning in a free-to-shrink state at a dry bulb temperature of 150° C. and a wet bulb temperature of 90° C. for 20 minutes. The filaments were then subjected to dry heat for 3 minutes at 200° C. in a free-to-shrink state. A shrinkage of 21% occurred, provided a fiber of 3.0 denier per filament. This fiber had a dye intensity of 62 and a shade change of 5.

EXAMPLE 2

The polymer employed had a molecular weight of 41,000 and a content of:

| Monomer | Weight % |
|---|---|
| Acrylonitrile | 87.0 |
| Methyl methacrylate | 2.0 |
| Methacrylonitrile | 10.0 |
| Acrylamidomethylpropane sulfonic acid | 1.0 |

To 82 parts of polymer were added 18 parts of water and 0.25 parts of zinc stearate as lubricant. The polymer-water mixture was processed using a screw extruder and spinneret with 2,937 holes, each of 160 micron diameter. The melt temperature was 197° C. and the pump outlet was 171° C. The polymer melt was extruded at a rate of 36 lbs/hr. into a steam pressurized solidification zone maintained at a saturated steam pressure of 20 lbs./sq. inch gauge. The extrudate was stretched while in the solidification zone in two stages to achieve a stretch ratio of 7.6 in the first stage and a total stretch ratio of 37.1, relative to the linear speed of the melt through the spinneret, to achieve a filament of 3 deniers.

A stretched filament was conditioned in a free-to-shrink state for 20 minutes in an oven maintained at a dry bulb temperature of 150° C. and a wet bulb temperature of 90° C. The conditioned fiber was then autoclaved at a steam pressure of 21 lbs. for 15 minutes in a free-to-shrink condition. The filament underwent 23% shrinkage resulting in a fiber of 7.1 denier per filament. The fiber exhibited a dye intensity of 63 and a shade change of 14.

EXAMPLE 3

The procedure of Example 2 was followed except for the following. The polymer was of 40,000 molecular weight and had the following composition:

| Monomer | Weight % |
|---|---|
| Acrylonitrile | 87.5 |
| Methylmethacrylate | 11.5 |
| Acrylamidomethylpropane sulfonic acid | 1.0 |

To 86.6 parts of polymer were added 13.4 parts water and 0.25 parts of a glycerol stearate type lubricant. The spinneret had 2937 holes, each of 120 micron diameter, the melt temperature was 172° C. and the pump outlet was at 153° C. The polymer melt was processed at 35 lbs./hr. and stretching was in two stages, a stretch ratio of 5.5 in a first stage and a total stretch ratio of 42.9 were achieved to provide a filament of 3.7 deniers. The fiber was conditioned and autoclaved as in Example 2 during which processing 30% shrinkage occurred yielding a fiber of 5.3 denier/filament. The fiber had a dye intensity of 72 and a shade change of 13.

EXAMPLE 4

The procedure of Example 2 was again followed. The polymer had a molecular weight of 49,000 and was obtained by polymerizing acrylonitrile and methyl methacrylate in the presence of polyvinyl alcohol such that the final composition contained 82.5 parts acrylonitrile, 11.0 parts methyl methacrylate and 6.5 parts polyvinyl alcohol. To 79.5 parts of polymer were added 20.5 parts water and 0.25 parts of glycerol stearate type lubricant. The polymer melt temperature was 178° C. and the pump outlet was 161° C. The melt was extruded at 28 lbs./hr. Stretching was at a stretch ratio of 3.7 in a first stage and 34.1 total to yield a filament of 5 denier. The filaments were conditioned as in Example 2 during which processing 32% shrinkage occurred yielding a fiber of 8.0 denier per filament. The fiber had a dye intensity of 74 and a shade change of 5.

EXAMPLE 5

The procedure of Example 2 was again followed. The polymer was again prepared in the presence of polyvinyl alcohol such that the final composition contained 84.1 parts acrylonitrile, 11.9 parts methyl methacrylate, 0.5 parts acrylamidomethylpropane sulfonic acid and 3.5 parts polyvinyl alcohol. The polymer had a molecular weight of 41,900. To 82 parts of polymer composition were added 18 parts water and 0.25 parts of a glycerol stearate type lubricant. The spinneret had 2937 holes each of 120 micron diameter. The polymer melt was at 178° C. and pump outlet at 166° C. The melt was extruded at 28 lbs./hr. Stretching was in a first stage at a stretch ratio of 3.4 and total stretch ratio was 18.6 to provide a filament denier of 3. The filaments were conditioned as in Example 4 during which processing shrinkage of 30% occurred to yield a fiber of 9 denier/-filament. The fiber had a dye intensity of 81 and a shade change of 15.

EXAMPLE 6

The procedure of Example 5 was repeated using the same polymer composition. To 84.8 parts polymer composition were added 15.2 parts water and 0.25 part of glycerol stearate type lubricant. The polymer melt was at 175 and pump outlet at 162° C. The polymer melt was processed at 33 lbs./hr. A first stage stretch was at a ratio of 3.4 and total stretch ratio was 29.2 to yield a filament denier of 2. The filaments were conditioned in a free-to-shrink state at a dry bulb temperature of 138° C. and a wet bulb temperature of 74° C. for 20 minutes followed by autoclaving at 21 lbs steam for 15 minutes during which processing 30% shrinkage occurred to yield a fiber of 4.6 denier per filament. The fiber had a dye intensity of 77 and a shade change of 12.

EXAMPLE 7

The process of Example 5 was again repeated using the same polymer composition. To 82.7 parts polymer composition were added 17.3 parts water and 0.25 parts of a glycerol stearate type lubricant. The melt was at 175° C. and the pump outlet at 158° C. The melt was extruded at 33 lbs./hr. A first stage stretch was at a ratio of 3.2 and total stretch was at a ratio of 28.6 to provide a filament denier of 2. The fiber was conditioned as in Example 5 and during such processing 30% shrinkage occurred to provide a fiber of 5.0 denier per filament. The fiber had a dye intensity of 83 and a shade change of 9.

The above examples serve to show that the acrylonitrile polymer fiber of the present invention distinguishes over other melt-spun acrylonitrile polymer fiber in view of its high dye intensity and low shade change due to hot-wet processing. The following examples serve to distinguish the acrylonitrile polymer fiber of the present invention from acrylonitrile polymer fiber prepared by wet-spinning or dry-spinning procedures. Physical properties of commercial acrylic fibers which are wet-spun or dry-spun, as given in *Textile World Manmade Fiber Chart*, 1977, McGraw Hill, New York, N.Y. include the following:

Straight tenacity = 2.0–3.6 grams per denier
Loop tenacity = 1.8–2.3 grams per denier.

EXAMPLE 8

The polymer of Example 5 was again employed. To 84 parts of polymer composition were added 16 parts water and 0.25 parts of a glycerol stearate type lubricant. The spinneret had 17,059 orifices each of 85 micron diameter. The melt was extruded at 166° C. The extrudate was extruded directly into a steam pressurized solidification zone maintained at a saturated steam pressure of 20 lbs./sq. in. gauge and was stretched in two stages, the first at a stretch ratio of 3.2 and the second at a stretch ratio which provided a total stretch ratio of 47.5 while the extrudate remained in the solidification zone. The resulting filaments were dried and relaxed as in Example 2 and 30% shrinkage occurred to increase the original size from 1.0 to 1.5 denier per filament. Physical properties of the resulting fiber are given in Table I below which also gives comparable properties for wet-spun commercial acrylonitrile polymer fiber (Creslan ®).

TABLE I

Comparison Of Melt-Spun And Wet-Spun Acrylonitrile Polymer Fibers

| Physical Property | Fiber: Melt-Spun Example 8 | Fiber: Wet Spun Commercial |
|---|---|---|
| Denier/Filament | 1.5 | 1.5 |
| Straight Tenacity, grams/denier | 4.4 | 2.0–3.0 |
| Loop Tenacity, grams/denier | 2.8 | 1.9–2.3 |
| Hot-Wet Modulus, grams/denier | 0.6 | 0.4 |

TABLE I-continued

| Comparison Of Melt-Spun And Wet-Spun Acrylonitrile Polymer Fibers | | |
|---|---|---|
| | Fiber | |
| Physical Property | Melt-Spun Example 8 | Wet Spun Commercial |
| Shade Change | 2 | 2 |
| Dye Intensity | 87 | 100 |

EXAMPLE 9

The fibers compared in Example 8 were processed into yarns via ring and open end spinning using cotton system on commercial textile equipment to evaluate textile performance. Results are given in Tables II and III below.

TABLE II

| Open End Yarn Physical Properties | | | | |
|---|---|---|---|---|
| | 18's/l cc | | 36's/l cc | |
| | Example 8 | Commercial | Example 8 | Commercial |
| Average Yarn Number c.c.* | 18.1 | 18.7 | 35.6 | 36.9 |
| Skein Break - pounds | 135 | 100 | 54 | 37 |
| Yarn Strength (C × S) | 2437 | 1854 | 1921 | 1381 |
| Shrinkage % | 4.9 | 8.3 | 3.6 | 6.7 |
| Coefficient of Variance, % (Yarn) | 11.3 | 11.0 | 15.5 | 15.0 |
| Single End Break, grams (SEB) | 523 | 377 | 283 | 199 |
| Single End Elongation % | 23.8 | 22.1 | 22.5 | 19.3 |
| Coefficient of Variance % (SEB) | 7.0 | 7.6 | 10.0 | 15.2 |
| Twist Multiplier | 4.2 | 4.2 | 4.8 | 4.8 |

*c.c. = cotton count

The results given in Table II show that both the straight and loop tenacities of the fiber of the present invention are higher than the commercial fiber. Other fiber properties of the two fibers were similar.

The results given in Table III show that yarns made from the fiber of the present invention have higher strength, higher single end breaks and higher spin limit than yarns made from the commercial fiber. The fiber of the present invention produces acceptable quanlity yarns at lower twist multiplier than typically used for commercial fiber thus enabling higher productivity to be achieved in yarn spinning. Spin limits of up to yarn counts of 70's are possible with the fiber of the present invention while commercial fiber can only produce such fine yarns when the fiber has a size less than 1 denier per filament.

We claim:

1. A melt-spun acrylonitrile polymer fiber wherein said acrylonitrile polymer has a composition of 87.6 parts acrylonitrile, 11.9 parts methyl methacrylate, 0.5 parts acrylamidomethylpropane sulfonic acid, and 3.5 parts polyvinyl alcohol, said fiber having a dye intensity of at least about 60, a shade change due to hot-wet processing of less than about 15, a straight tenacity of greater than about 3.8 grams per denier, a loop tenacity of greater than 2.5 grams per denier, and providing higher yarn spin limits than acrylonitrile polymer fiber produced by other spinning procedures while also providing higher yarn strength and single end breaks than comparable yarn spun from acrylonitrile polymer fiber produced by other spinning procedures.

2. A melt-spun acrylonitrile polymer fiber wherein said acrylonitrile polymer has a composition of 89 parts acrylonitrile, 11.0 parts methlmethacrylate and 6.5 parts polyvinyl alcohol, said fiber having a dye intensity of at least about 60, a shade change due to hot-wet processing of less than about 15, a straight tenacity of greater than about 3.8 grams per denier, a loop tenacity of greater than 2.5 grams per denier, and providing higher yarn spin limits than acrylonitrile polymer fiber produced by other spinning procedures while also providing higher yarn strength and single end breaks than comparable yarn spun from acrylonitrile polymer fiber produced by other spinning procedures.

* * * * *

TABLE III

| Ring Spun Yarn Physical Properties | | | | | | |
|---|---|---|---|---|---|---|
| | 18's/l cc | | 36's/l cc | | 50's/l cc | |
| | Example 8 | Commercial | Example 8 | Commercial | Example 8 | Commercial |
| Average Yarn Number | 17.4 | 17.8 | 35.4 | 36.9 | 50.3 | Could not be spun into 50's/l cc yarn. Spin limit is 40's/l cc, 3.25 TM. |
| Skein Break | 185 | 147 | 93 | 66 | 54 | |
| Yarn Strength | 3226 | 2632 | 3296 | 2422 | 2722 | |
| Shrinkage % | 3.7 | 5.7 | 6.7 | 3.9 | 2.1 | |
| Yarn Coefficient of Variance | 9.3 | 13.0 | 15.1 | 15.1 | 11.6 | |
| Single End Break (SEB) | 784 | 563 | 382 | 277 | 240 | |
| Single End Elongation | 26.4 | 26.6 | 22.6 | 24.0 | 22.1 | |
| SEB Coefficient of Variance | 10.7 | 8.2 | 9.3 | 12.6 | 10.8 | |
| Twist Multiplier (TM) | 3.25 | 3.25 | 3.0 | 3.5 | 2.4 | |